US006804481B2

(12) United States Patent
Mochizuki et al.

(10) Patent No.: US 6,804,481 B2
(45) Date of Patent: Oct. 12, 2004

(54) IMAGE FORMING APPARATUS

(75) Inventors: Jun Mochizuki, Toride (JP); Takeshi Tomizawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/412,246

(22) Filed: Apr. 14, 2003

(65) Prior Publication Data

US 2003/0215251 A1 Nov. 20, 2003

(30) Foreign Application Priority Data

Apr. 16, 2002 (JP) ..... 2002-112975

(51) Int. Cl.[7] ..... G03G 15/16
(52) U.S. Cl. ..... 399/66; 399/44; 399/297
(58) Field of Search ..... 399/44, 66, 297

(56) References Cited

U.S. PATENT DOCUMENTS

| | | | | |
|---|---|---|---|---|
| 4,110,031 A | * | 8/1978 | Ebi et al. | 399/66 |
| 5,250,999 A | * | 10/1993 | Kimura et al. | 399/66 |
| 5,260,751 A | * | 11/1993 | Inomata | 399/66 |
| 6,038,411 A | * | 3/2000 | Gotoh | 399/66 |
| 6,219,496 B1 | * | 4/2001 | Kojima et al. | 399/66 |
| 6,324,358 B1 | * | 11/2001 | Sahara | 399/66 |
| 6,434,344 B1 | * | 8/2002 | Yoshida et al. | 399/44 |
| 6,529,693 B2 | | 3/2003 | Tomizawa et al. | 399/44 |

FOREIGN PATENT DOCUMENTS

| | | |
|---|---|---|
| JP | 8-286528 | 11/1996 |
| JP | 9-325625 | 12/1997 |

* cited by examiner

*Primary Examiner*—Fred Braun
(74) *Attorney, Agent, or Firm*—Fitzpatrick, Cella, Harper & Scinto

(57) ABSTRACT

An image forming apparatus includes image forming device for forming an image on a first image bearing member, a transfer member, capable of contacting the first image bearing member, for transferring the image on the first image bearing member to a second image bearing member, a power supply for applying a bias to the transfer member, detection device for detecting a voltage value and a current value at the time of applying the bias to the transfer member, speed change member capable of changing a moving speed of the first image bearing member, environment detection element for detecting a temperature or a humidity, and control device for determining a transfer voltage value at the time of image transfer on the basis of an output of the detection device at the time of applying the bias to the transfer member other than the time of image transfer. The image forming device is capable of forming an image at different speeds, and the control device determines a transfer voltage value, on the basis of an output of the detection device at a predetermined speed of the first image bearing member and an output of the environment detection element, at a speed other than the predetermined speed.

11 Claims, 7 Drawing Sheets

IMAGE FORMING APPARATUS

FIELD OF THE INVENTION AND RELATED ART

The present invention relates to an image forming apparatus such as a printer, and specifically relates to an image forming apparatus performing image formation by transferring a toner image onto a member to be transferred.

In a conventional image forming apparatus using an electrophotographic system, a transfer means principally using a contact charging scheme adopts a control method, which is called "ATVC (active transfer voltage control)" method, wherein a current is caused to flow through a transfer portion at a time other than the time of image transfer and an optimum transfer bias is set on the basis of current and voltage values at that time.

This control method will be described with reference to FIG. 10. FIG. 10 is an explanatory view of the conventional image forming apparatus.

Referring to FIG. 10, the image forming apparatus includes a photosensitive drum 101 as an image bearing member, a primary charging means 102, an exposure means 103, a developing means 104, a transfer means 105, an a cleaner 106.

After the photosensitive drum 101 is uniformly charged by the primary charging means (charger) 102, an electrostatic latent image is formed on the photosensitive drum 101 by performing image exposure based on an image signal by means of the exposure means 103. Thereafter, the latent image is developed with a toner by the developing means (apparatus) 104 to form a toner image, and the toner image formed on the photosensitive drum 101 is transferred onto a transfer medium P. Toner particles remaining on the photosensitive drum 101 after the transfer operation are recovered by the cleaner 106.

In FIG. 10, the transfer means 105 is of a contact charging scheme using an elastic roller which has been frequently used conventionally in the electrostatic image forming apparatus in view of advantages, such as ozone-less system and cost reduction.

However, it is difficult to suppress an irregularity in resistance of the elastic roller as the above-mentioned transfer means (hereinafter referred to as a "transfer roller") at the time of production, and the resistance varies depending on a change in temperature and/or humidity in an ambient environment and a deterioration of the transfer roller in successive image formation.

For this, reason, a method wherein a control means capable of allowing constant current control and constant voltage control with respect to a transfer high-voltage power supply and a detection means for detecting voltage and current at the time of constant current/voltage control are used so that a transfer bias is subjected to the constant current control at the time of pre-rotation for image formation and a charge potential of the photosensitive drum 101 at that time and an optimum transfer voltage at that time with respect to a resistance of the transfer roller 105 are detected to effect a constant voltage control with the detected transfer voltage when an image is transferred, has been known. According to this method, it is possible to effect an optimum transfer operation at an once determined voltage value, irrespective of a size of the transfer medium P.

On the other hand, some proposals as to an image forming apparatus capable of setting a plurality of speeds of the image bearing member and a member to be transferred at the transfer portion have been made.

Japanese Laid-Open Patent Application (JP-A) No. Hei 09-325625 discloses a method wherein a peripheral speed of a photosensitive drum is decreased in order to realize a high resolution of a laser beam printer to increase a density of laser scanning to the photosensitive drum without increasing a rotation speed of a polygon mirror for the laser scanning. At this time, with the decrease of rotation speed of the photosensitive drum, a speed of transfer means is also decreased.

Further, JP-A Hei 08-286528 discloses a method wherein a fixing speed is effectively lowered in order to ensure sufficient gloss and color-mixing properties for images in the case of using thick paper or OHP sheet as a transfer medium to correspondingly decrease a speed of transfer means.

However, in the above-mentioned methods wherein the transfer speed is lowered, the resultant transfer bias is deviated from an optimum value to cause a problem of an occurrence of image failure. With respect to this problem, in the methods described in JP-A Hei 09-325625 and JP-A Hei 08-286528 the above-mentioned ATVC is performed at each of a plurality of different transfer speeds to set optimum transfer bias at the respective transfer speeds.

However, a long image forming time is caused by performing the ATVC at the time of pre-rotation for image forming operation. The method performing the ATVC at the respective transfer speeds when the transfer speed is changed has accompanied with a problem of a longer image forming time at a slower transfer speed. Further, even in the image forming apparatus effecting the ATVC only at a specific time for each time of printing on a predetermined number of sheets or for each elapsed time, not for each image formation operation, it is necessary to perform the ATVC operation while changing the transfer speed as occasion demands, thus resulting in such a problem that users are kept waiting for a long time due to such ATVC operations.

In order to solve the problem, JP-A Hei 09-325625 discloses that current measurement corresponding to different speeds is performed by detecting a resistance of the transfer member at the fastest process speed.

However, in the case where, on the basis of a measurement result at a speed, a transfer condition at another speed is determined, there are many uncertain factors other than a difference in speed. As a result, it becomes difficult to accurately set transfer conditions.

SUMMARY OF THE INVENTION

An object of the present invention is to provide an image forming apparatus having different image forming speeds, capable of reducing a time required for determining conditions for transfer control.

Another object of the present invention is to provide an image forming apparatus having different image forming speeds, capable of performing accurate transfer control without being affected by environmental conditions.

According to the present invention, there is provided an image forming apparatus, comprising:

image forming means for forming an image on a first image bearing member, a transfer member, capable of contacting the first image bearing member, for transferring the image on the first image bearing member to a second image bearing member, a power supply for applying a bias to the transfer member, detection means for detecting a voltage value and a current value at the time of applying the bias to the transfer member, speed change means capable of changing a moving speed of the first image bearing member, environment detection means for detecting a temperature or a humidity, and control means for determining a transfer voltage value at the time of image transfer on the basis of an output of the detection means at the time of applying the bias to the transfer member other than the time of image transfer, wherein the image forming means is capable of forming an image at different speeds, and the control means determines a transfer voltage value, on the basis of an output of the detection means at a predetermined speed of the first image bearing member and an output of the environment detection means, at a speed other than the predetermined speed.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
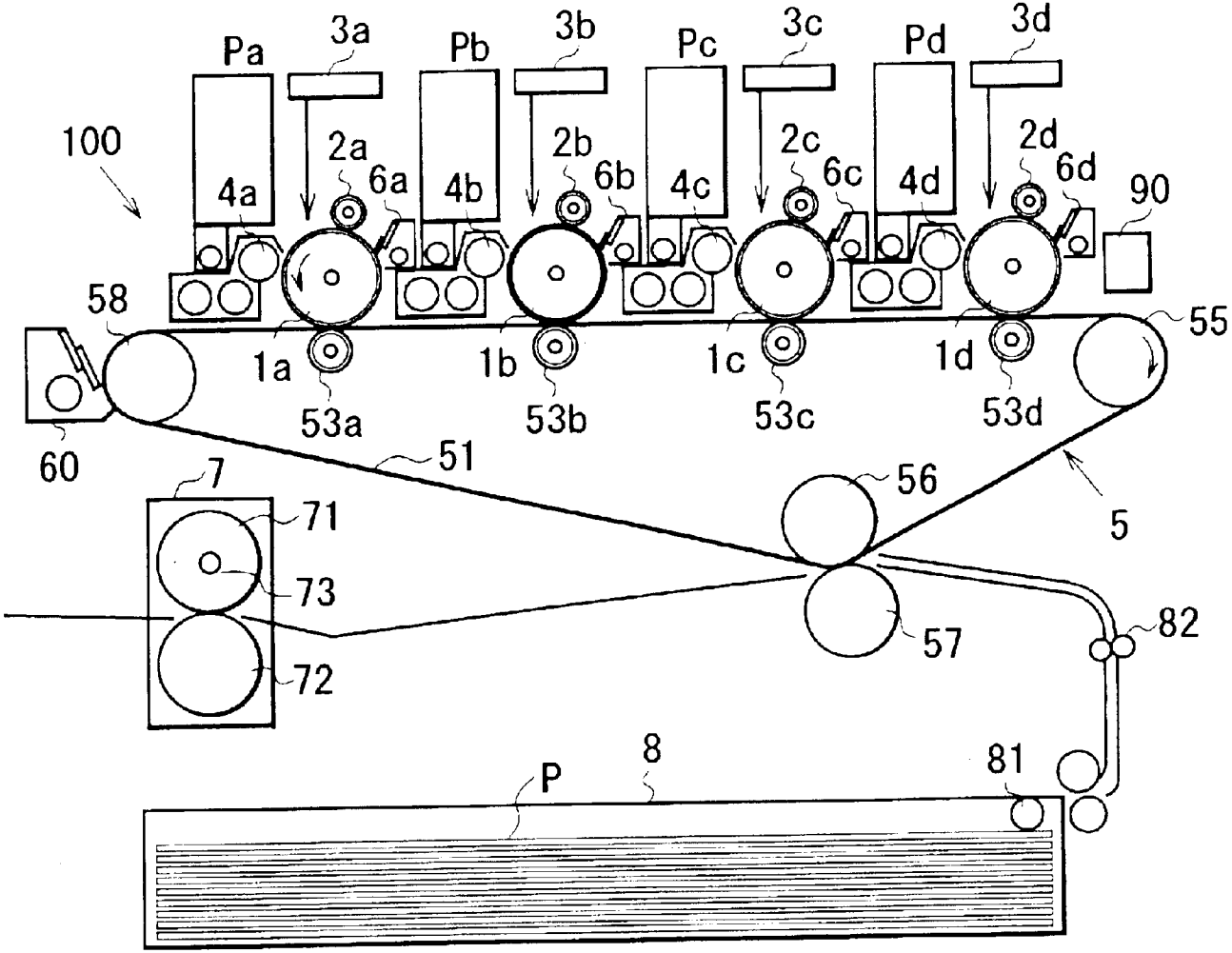
FIG. 1 is a schematic sectional view of an image forming apparatus according to Embodiment 1 appearing hereinafter.

Embodiment 1 of the present invention will be described with reference to the drawings. FIG. 1 is a schematic sectional view showing the periphery of an image bearing member in an image forming apparatus according to this embodiment.

Referring to FIG. 1, an image forming apparatus 100 has four photosensitive drums 1*a* to 1*d* and is a full-color electrophotographic image forming apparatus using intermediate transfer members. Around the respective photosensitive drums 1*a* to 1*d*, process units Pa to Pd including charging rollers 2*a* to 2*d*, exposure apparatus 3*a* to 3*d*, developing apparatus 4*a* to 4*d*, cleaners 6*a* to 6*d*, etc., are provided. By the respective Pa to Pd, color images of yellow, magenta, cyan and black are respectively formed. Each of the photosensitive drums 1*a* to 1*d* is disposed rotatably in a direction of an arrow in the drawing.

The image formed on each of the photosensitive drums 1*a* to 1*d* is successively transferred onto an intermediary transfer belt (belt-shaped image bearing member) 51 at each of primary transfer portions where each transfer roller 53*a*, 53*b*, 53*c* or 53*d* is disposed while the intermediary transfer belt 51 moves and passes through each primary transfer portion in adjacent to each of the photosensitive drum 1*a* to 1*d*. The image transferred onto the intermediary transfer belt 51 is then transferred onto a transfer medium such as paper at a secondary transfer portion where secondary transfer rollers 56 and 57 are disposed.

Figure 2:
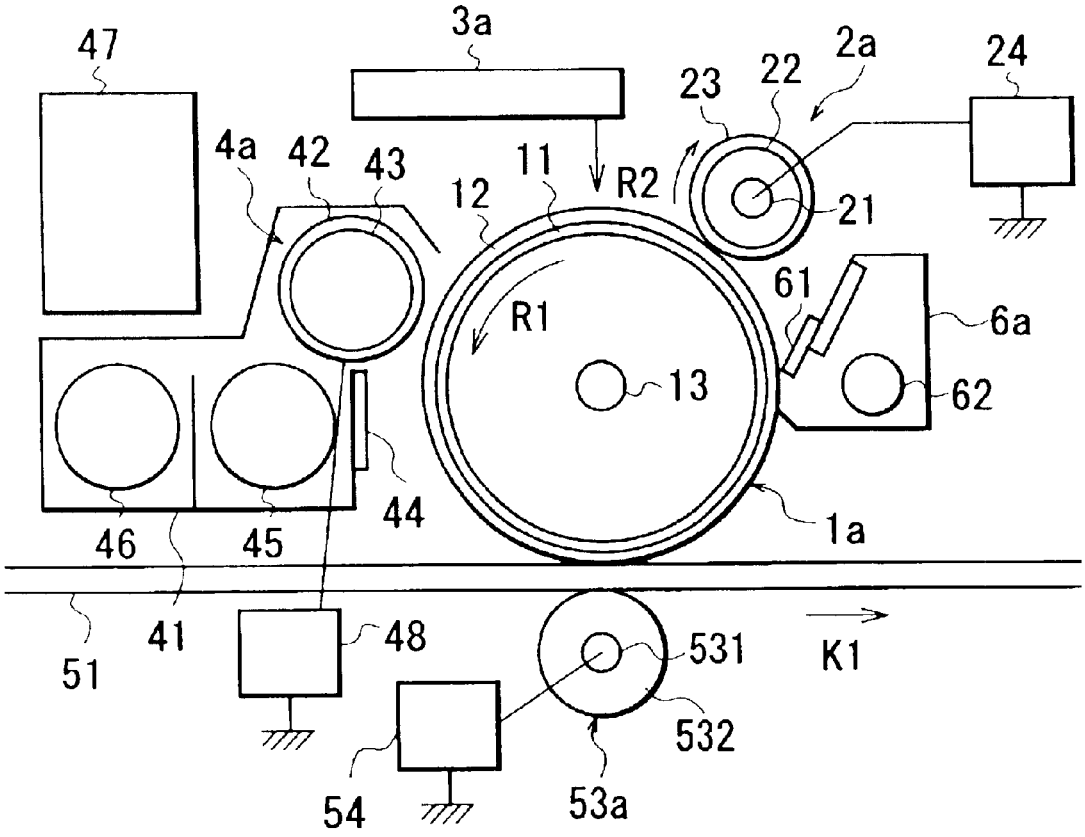
FIG. 2 is a schematic sectional view of a process unit in the image forming apparatus according to Embodiment 1.

The above-mentioned process units Pa to Pd will be described with reference to FIG. 2 showing the process unit Pa since all the process units Pa to Pd have an identical configuration.

Referring to FIG. 2, the process unit Pa is provided with the photosensitive drum 1*a* rotatably supported by an main body (not shown) of the image forming apparatus. The photosensitive drum 1*a* is an ordinary organic photosensitive drum comprising an electroconductive support 11 of, e.g., aluminum, and a photoconductive layer 12 formed at the peripheral surface of the electroconductive support 11. The photosensitive drum 1*a* has a shaft (axis) 13 and is rotationally driven around the shaft 13 in a direction of an arrow R1 by drive means (not shown).

Above the photosensitive drum 1*a*, the charging roller 2*a* is disposed and designed in a roller shape so as to contact and uniformly charge the surface of the photosensitive drums to a predetermined polarity and a predetermined potential.

The charging roller 2*a* is comprised of an electroconductive core metal 21 disposed at a center thereof, a low-resistance electroconductive layer 22 formed around the core metal 21, and a medium-resistance electroconductive layer 23 disposed around the low-resistance electroconductive layer 22. At both longitudinal end portions of the core metal 21, the charging roller 2*a* is rotatably supported by bearing members (not shown) and is arranged in substantially parallel with the photosensitive drum 1*a*.

The bearing member of the core metal 21 is pressed against the center of the photosensitive drum 1*a* by a pressing means (not shown), whereby the charging roller 2*a* abuts against the surface of the photosensitive drum 1*a* at a predetermined pressure. The charging roller 2*a* is rotationally driven in a direction of an arrow R2 by the photosensitive drum 1*a* rotated in the direction of the arrow R1. The charging roller 2*a* is designed to be supplied with a bias voltage from a power supply 24 to uniformly contact and charge the surface of the photosensitive drum 1*a*.

On the downstream side from the charging roller 2*a* along the rotation direction of the photosensitive drum 1*a*, the exposure apparatus 3*a* is disposed. The exposure apparatus 3*a* exposes the surface of the photosensitive drum 1*a* to light by effecting scanning of the photosensitive drum surface while turning laser light on and off, thus forming an electrostatic latent image corresponding to image information.

The developing apparatus 4*a* disposed downstream from the exposure apparatus 3*a* has a developer container 41 into which a developing sleeve 42 is rotatably disposed at an opening portion facing the photosensitive drum 1*a*. Within the developing sleeve 42, a magnet roller 43 for carrying a developer on the surface of the developing sleeve 42 is fixedly disposed in a non-rotational state. At a lower position of the developing sleeve 42 of the developer container 41, a regulation blade 44 for forming a thin layer of the developer by regulating the developer carried on the developing sleeve 42 is disposed. Further, within the developer container 41, partitioned developing chamber 45 and stirring chamber 46 are disposed and above the chambers, a replenishing chamber 47 containing a toner for replenishment is disposed.

When the developer formed in the thin layer is carried to a developing region opposite to the photosensitive drum 1*a*, a chain of the developer is formed in the developing region by a magnetic force of a primary developing pole of the magnetic roller 43 located in the developing region to provide a magnetic brush of the developer. The surface of the photosensitive drum 1*a* is rubbed with the magnetic brush while applying a developing bias voltage to the developing sleeve 42 from a power supply 48, whereby a toner attached to a carrier constituting the chain of the developer is caused to attach to an exposure part of the electrostatic latent image, thus forming a toner image on the photosensitive drum 1*a*.

Below the photosensitive drum 1*a* downstream from the developing apparatus 4*a*, the transfer roller 53*a* is disposed via the intermediary transfer belt 51 and includes a core metal 531 and a cylindrical electroconductive layer 532 disposed around the peripheral surface of the core metal 531. The transfer roller 53*a* is pressed against the center of the photosensitive drum 1*a* by a pressing member of, e.g., spring (not shown) at both longitudinal end portions thereof.

As a result, the electroconductive layer 532 of the transfer roller 53*a* is pressed against the surface of the photosensitive drum 1*a* via the intermediary transfer belt 51 at a predetermined pressing force, so that a transfer nip portion is formed between the photosensitive drum 1*a* and the transfer roller 53*a* through the intermediary transfer belt 51. A toner negatively charged by a potential difference between the photosensitive drum 1*a* and the transfer roller 53*a* is transferred from the surface of the photosensitive drum 1*a* onto the surface of the intermediary transfer belt 51. The photosensitive drum 1*a* after the image transfer is subjected to removal of attached matter such as residual toner by the cleaner 6*a*. The cleaner 6*a* has a cleaner blade 61 and a conveying screw 62. The cleaner blade 61 is pressed against the photosensitive drum 1*a* by a pressing means (not shown) at a predetermined angle and a predetermined pressure, thus recovering the toner etc. measuring on the surface of the photosensitive drum 1*a*. The thus recovered residual toner etc. is conveyed and discharged by the conveying screw 62.

Referring again to FIG. 1, below the respective photosensitive drums 1*a* to 1*d*, an intermediary transfer unit 5 is disposed. The intermediary transfer unit 5 includes the intermediary transfer belt 51, transfer rollers 53*a* to 53*d*, an intermediary transfer belt drive roller 55, secondary transfer rollers 56 and 57, a tension roller 58, and an intermediary transfer belt cleaner 60.

The intermediary transfer belt 51 may be formed of a dielectric resin such as PC, PET or PVDF. In this embodiment, the belt 51 is formed of a 90 $\mu$m-thick PI resin having a volume resistivity of $10^9$ ohm.cm (as measured by using a probe according to JIS-K6911 under application of a voltage of 100 V for 60 sec in an environment of 23° C. and 60% RH).

The transfer roller 53*a* is formed of a 8 mm-ø-core metal coated with a 4 mm-thick electroconductive urethane sponge layer, and has a resistance of about $10^5$ ohm (23° C., 60% RH) obtained on the basis of a relationship of a current with a voltage when the transfer roller 53*a* is pressed against an opposing roller which is grounded at a load of 500 g-force and a voltage of 100 V is applied to the core metal while rotating the transfer roller 53*a* at a peripheral speed of 50 mm/sec.

As described above, the respective color toner images formed on the photosensitive drums 1*a* to 1*d* are transferred to the secondary transfer portion with the rotation of the intermediary transfer belt 51 after being successively transferred onto the belt 51. On the other hand, until this time, the transfer medium P supplied from a paper-feeding cassette 8 is carried to the secondary transfer portion via a pickup roller 81 and conveyance rollers 82. At the secondary transfer portion 82, the above-mentioned toner images are transferred onto the transfer medium P by a secondary transfer bias applied between the secondary transfer rollers 56 and 57. The residual toner remaining on the intermediary transfer belt 51 is removed and recovered by the intermediary transfer belt cleaner 60.

The inner secondary transfer roller 56 is formed of a 16 mm-ø-core metal coated with a 7 mm-thick electroconductive urethane solid layer, and has a resistance of about $10^5$ ohm (23° C., 50% RH) obtained on the basis of a relationship of a current with a voltage when the inner secondary transfer roller 56 is grounded at a load of 500 g-force and a voltage of 100 V is applied to the core metal while rotating the inner secondary transfer roller 56 at a peripheral speed of 50 mm/sec.

The outer secondary transfer roller 57 is formed of a 16 mm-ø-core metal coated with a 7 mm-thick electroconductive EPDM sponge layer, and has a resistance of about $10^8$ ohm (23° C., 50% RH) obtained on the basis of a relationship of a current with a voltage when the outer secondary transfer roller 57 is grounded at a load of 500 g-force and a voltage of 2000 V is applied to the core metal while rotating the outer secondary transfer roller 57 at a peripheral speed of 50 mm/sec.

A fixing apparatus 7 includes a rotatably disposed fixing roller 71 and a pressure roller 72 rotating in contact with the fixing roller 71. Inside the fixing roller 71, a heater 73 such as a halogen lamp is disposed, and temperature control at the surface of the fixing roller 71 is performed by controlling a voltage etc. applied to the heater 71. In such a state, when the transfer medium P is carried, the fixing roller 71 and the pressure roller 72 rotate at a certain speed to press and heat the transfer medium P from both sides of the transfer medium P under application of substantially constant pressure and heat at the time when the transfer medium P passes between the fixing roller 71 and the pressure roller 72. As a result, a yet-fixed toner image carried on the transfer medium P is fixed in a molten state to form a full-color image on the transfer medium P.

Further, a control means 90 control the entire operation of the image forming apparatus 100.

Hereinbelow, as a characteristic feature of the present invention, a manner of setting a transfer voltage at a ½ speed mode on the basis of a relationship between a transfer current and a transfer voltage obtained in the ATVC operation at an ordinary speed mode will be explained by taking the primary transfer of the above-mentioned image forming apparatus as an example.

Figure 3:
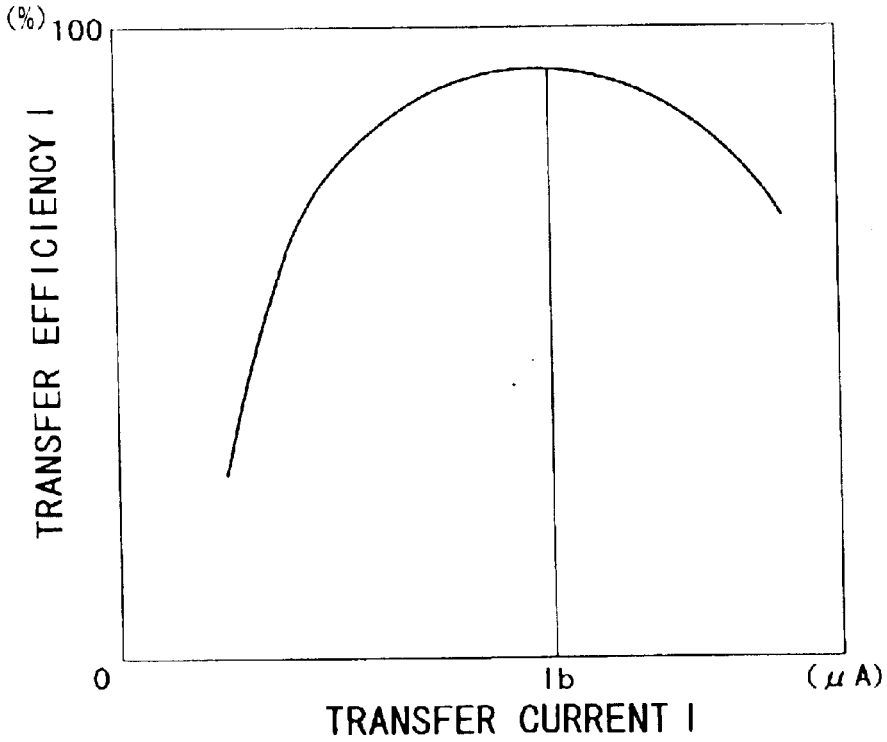
FIG. 3 is a graph showing a relationship between a transfer current and a transfer efficiency from a photosensitive drum to a member to be transferred.

FIG. 3 shows a relationship between a transfer current I and a transfer efficiency from the photosensitive drum 1 to the intermediary transfer belt 51 when a toner image is transferred from the photosensitive drum 1 onto the intermediary transfer belt 51.

According to our study, as shown in FIG. 3, the transfer efficiency from the photosensitive drum 1 to the intermediary transfer belt 51 is increased with an increasing transfer current I to reach a maximum transfer efficiency of a transfer current value close to a predetermined current value Ib, and then starts to decrease and cause an occurrence of transfer failure image which is called "white dropout" after the transfer current passes the current value Ib. At that time, discharge between the photosensitive drum 1 and the transfer roller 5 is considered to occur. As described above, the transfer efficiency of the toner is determined by the transfer current I, so that the transfer voltage is determined by the above-mentioned ATVC so as to always carry a desired predetermined transfer current Ib even when the resistance of the transfer roller 5 is changed in successive image formation.

Figure 4:
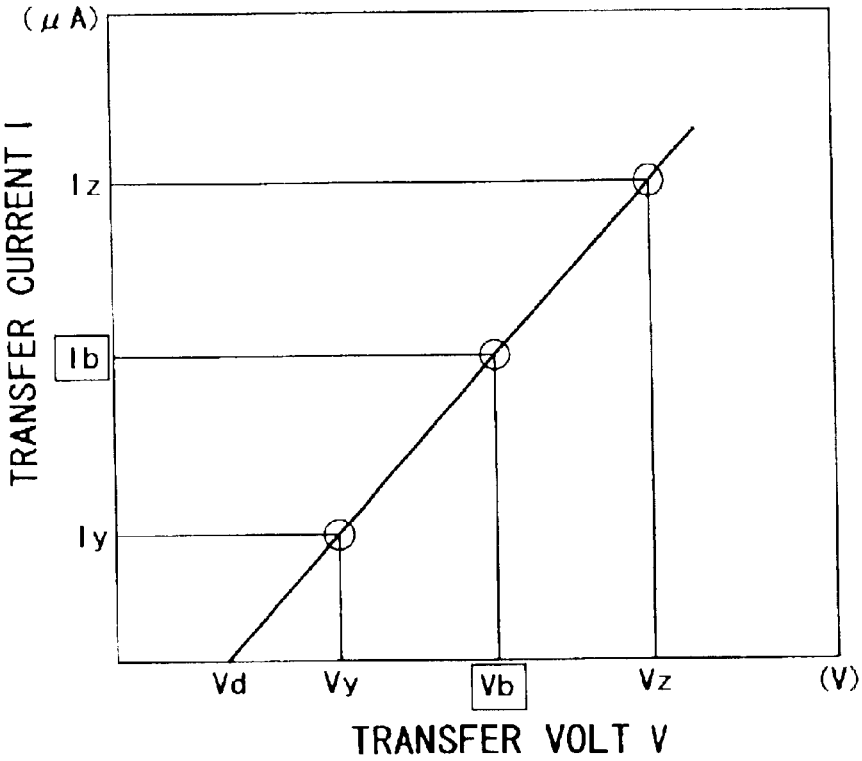
FIG. 4 is a graph for explaining a manner of obtaining a predetermined voltage required for providing an optimum current by linear interpolation.

With respect to the ATVC, several methods have been proposed heretofore. In this embodiment, a method wherein a transfer high-voltage power supply capable of performing a constant voltage control and an unshown detection means for detecting a voltage and a current at the time of the constant voltage control are used so that voltages Vy and Vz of two levels are applied to the transfer roller 5 for a period of one rotating thereof while charging the photosensitive drum 1 to a predetermined charge potential in the ATVC operation to obtain toner currents Iy and Iz under application of the voltages Vy and Vz, respectively, and a predetermined voltage Vb required to provide an optimum (predetermined) current value Ib is determined by linear interpolation on the basis of the relationship between the voltages and currents (FIG. 4), thus performing a constant voltage control with the voltage Vb at the time of image transfer, is used, Further, in this embodiment, a speed at the time of fixation with the transfer medium P is made variable. More specifically, the fixation is performed at a ½ speed mode (which speed is ½ of an ordinary fixing speed) for fixing thick paper or OHP paper requiring a higher amount of heat. At that time, the conveyance speed of the transfer medium P becomes ½ of the ordinary conveyance speed, so that the transfer speed from the intermediary transfer belt 51 to the transfer medium P at the secondary transfer portion and the transfer speeds from the photosensitive drums 1*a*–1*d* to the intermediary transfer member 51 also become ½ of the ordinary transfer speeds, respectively. If the transfer speed at the secondary transfer portion is set to the ordinary transfer speed, it is necessary to ensure a wide pace for reducing the conveyance speed of the transfer medium P after the second transfer, thus resulting in a large-sized apparatus. Further, if the transfer speed at the primary transfer portion is set to the ordinary speed and the transfer speed is reduced until the toner image reaches the secondary transfer portion, a distance between the primary and secondary transfer portions is similarly required to become longer. Further, if a reduction rotation such that the transfer speed at the primary transfer portion is set to the ordinary speed and reduced until the toner image is caused to pass through the secondary transfer portion without being transferred and again reaches the secondary transfer portion is performed, it is necessary to add a mechanism for attaching and detaching the intermediary transfer belt cleaner 60, thus resulting in a complicated apparatus.

Further, in the image forming apparatus of this embodiment, the predetermined current value (optimum transfer current value) Ib is determined, from the manner described with reference to FIG. 3, as 12 $\mu$A at a transfer speed of 120 mm/sec and 6 $\mu$A at a transfer speed of 60 mm/sec. Accordingly, the optimum transfer current is proportional to the transfer speed.

For this reason, in the image forming apparatus of this embodiment, it is necessary to determine a transfer voltage V1 for passing an optimum transfer current Ib1 at the ordinary transfer speed mode and a transfer voltage V2 for passing an optimum transfer current Ib2 at ½ transfer speed mode by using the ATVC. In this embodiment, the V2 value is calculated on the basis of the V1 value by obtaining the relationship between the transfer voltage V1 at the ordinary speed mode and the transfer voltage V2 at the ½ speed mode in advance. Incidentally, the optimum transfer current values Ib1 and Ib2 are determined beforehand and are used in such a state that they are stored in a memory of the main body of the image forming apparatus.

Figure 5:
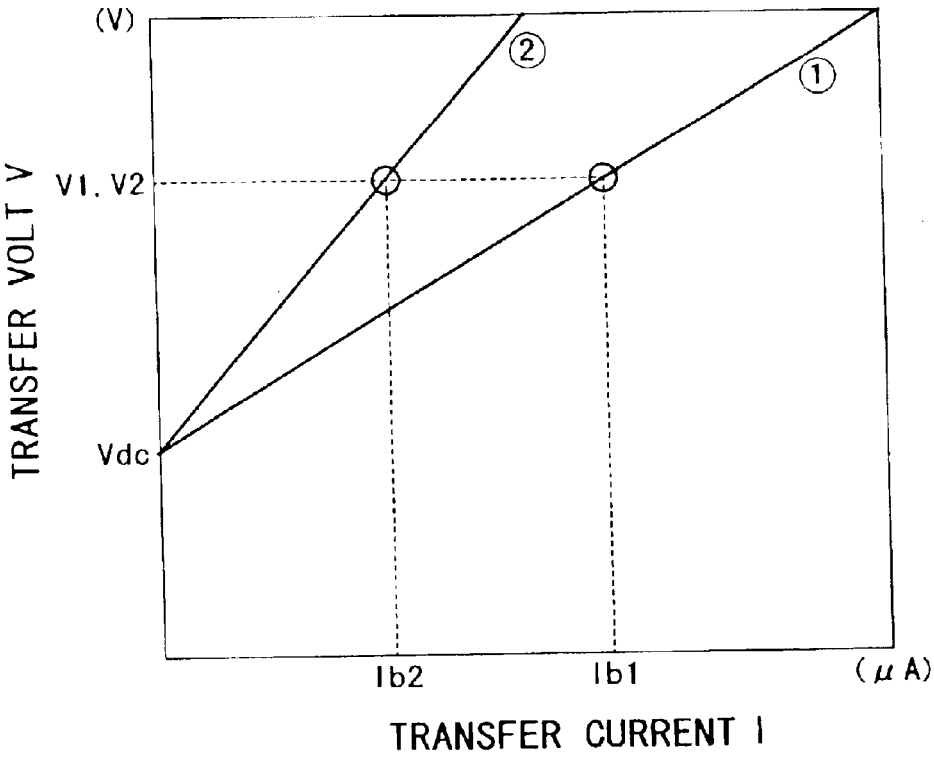
FIG. 5 is a graph showing a relationship between a transfer current and a transfer voltage at a primary transfer portion in Embodiment 1.

FIG. 5 is a graph showing a relationship between a transfer voltage V and a transfer current I flowing at the transfer voltage V at the primary transfer portion of the image forming apparatus according to this embodiment and is determined empirically with respect to the case of different transfer speeds. A straight line ① shows a relationship between the transfer voltage V and the transfer current I at a transfer speed S. If the transfer speed when the optimum current Ib1 flows is V1, the transfer speed V1 is represented by the following equation:

$$V1 = k \times Ib1 + Vdc \quad (1),$$

wherein k is a coefficient and Vdc is a discharge tart voltage.

In this case, a relationship between the transfer voltage V and the transfer current I when the transfer speed is S2 (S1>S2) is shown by a straight line ②. If the transfer voltage when the optimum transfer current Ib2 flows is V2, the transfer speed V2 is represented by the following equation:

$$V2 = A \times k \times Ib2 + Vdc \quad (2),$$

wherein A and k are coefficients and Vdc is a discharge start voltage. The coefficient k is common to the equations (1) and (2), and from experimental results, the discharge start voltages Vdc in the equations (1) and (2) have the same value. Further, the coefficient A is a coefficient for representing a difference in slope between the transfer voltage V and the transfer current I and is ordinarily represented by the following equation:

$$A = S1/S2 \quad (3).$$

More specifically, the equation (3) shows that the slope of the line 2 representing the relationship between the transfer voltage V and the transfer current I is inversely proportional to the transfer speed. Such a relationship between the transfer voltage V and the transfer current I exhibits a tendency for time factors to affect the voltage-current characteristic, i.e., a tendency to show a capacitor-like behavior. At the primary transfer portion, a coating layer of the photosensitive drum 1 disposed opposite to the transfer roller 53 is an insulating layer (dielectric layer), so that such a behavior is considered to be exhibited. Such a capacitor-like behavior is liable to be exhibited when the coating layer has a volume resistivity of not less than about $10^{14}$ ohm.cm.

On the other hand, as described above, the optimum transfer current is proportional to the transfer speed, so that the optimum transfer current Ib2 is represented by the following equation:

$$Ib2 = (S2/S1) \times Ib1 \quad (4).$$

Accordingly, from the above equations (1) to (4), the equation: V1=V2 . . . (5) holds, so that it has been confirmed that the optimum transfer voltage at the transfer speed S2 is identical to that at the transfer speed S1. In other words, if the optimum transfer voltage V1 is obtained by performing once the ATVC at the transfer speed S1, the optimum transfer voltage V2 at the transfer speed S2 can be determined from the equation (5) (V1=V2) without performing the ATVC.

However, as a result of our further study, it has been confirmed that the coefficient A representing the difference in slope between the transfer voltage V at different transfer speeds varies depending on an absolute humidity of ambient environment. In an ordinary environmental condition (temperature and humidity), the coefficient A is represented by the above equation (3) but in a lower-humidity (moisture content) environment, the coefficient value becomes smaller.

In this case, when factoring out the equation (3) representing the coefficient A, from the equations (1), (2) and (4), the following relationship holds.

$$V2=A\times(S2/S1)\times(V1-Vdc)+Vdc$$

If the coefficient A at that time is newly defined as an environmental coefficient H representing an environmental moisture content, the equation (6) and an available range of the coefficient H are represented by the following relationships:

$$V2=H\times(S2/S1)\times(V1-Vdc)+Vdc \quad (7),$$

and $$1\leqq H\leqq S1/S2 \text{ (with the proviso that } S1>S2).$$

Figure 6:
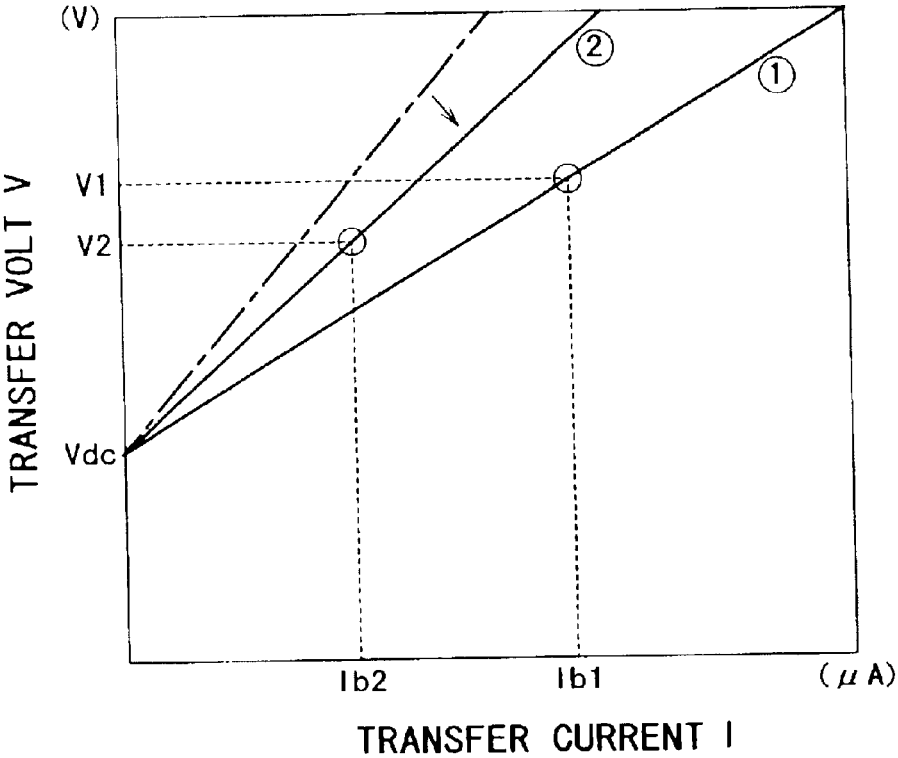
FIG. 6 is a graph showing a relationship between a transfer current and a transfer voltage in the case of a low ambience humidity at the primary transfer portion in Embodiment 1.

This equation (7) shows that H=S1/S2 is held in a normal temperature and normal humidity environment and the relationship between the transfer voltage V and the transfer current I is represented by a broken line shown in FIG. 6. As a result, although the slope of the line representing the relationship between the transfer voltage V and the transfer current I is inversely proportional to the transfer speed, the environmental coefficient H becomes smaller as the environmental humidity (moisture content) becomes smaller, so that the slope of the line ② at the transfer speed S2 comes near the slope of the line ① at the transfer speed S1 (FIG. 6). At that time, the optimum transfer voltage V2 at the transfer speed S2 is smaller than V1. When H=1, the line ② becomes equal to the line ①.

We measured values of the environmental coefficient H when the transfer speed S2 is half of the ordinary transfer speed S1, i.e., S1/S2=2, in terms of the relationship with the environmental humidity.

Figure 7:
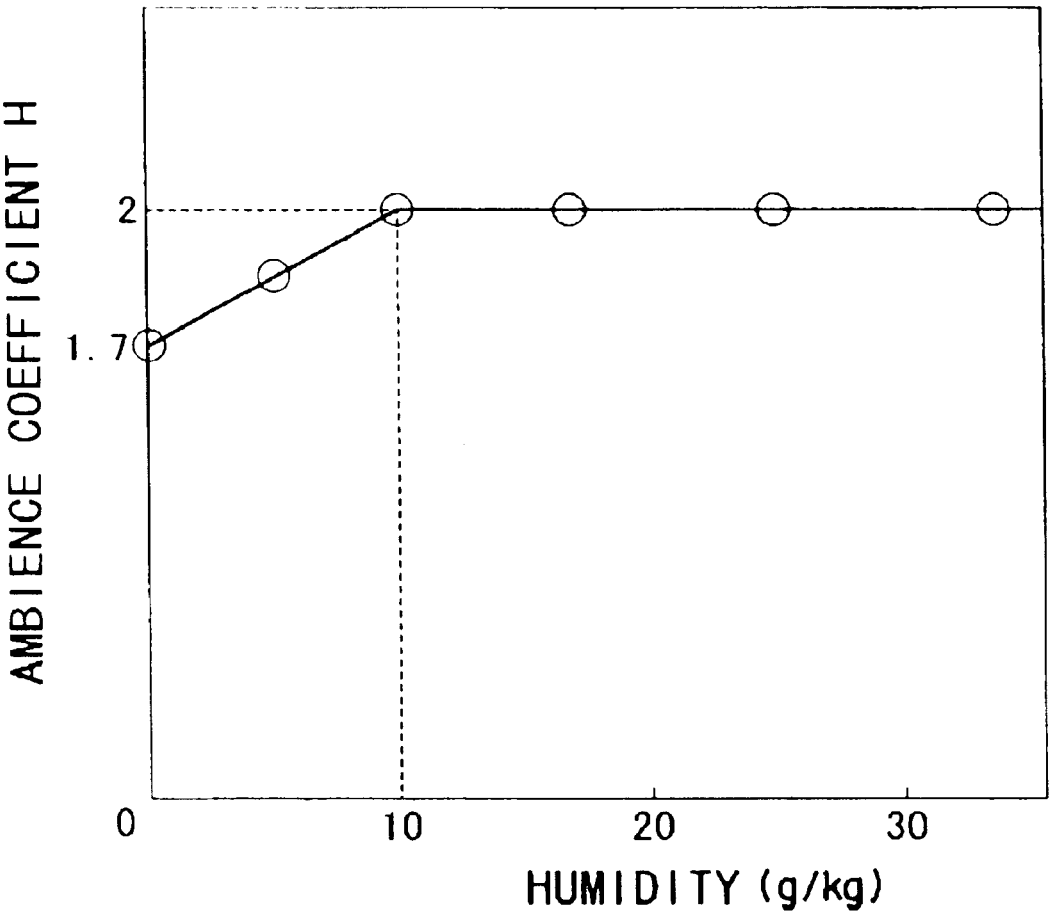
FIG. 7 is a graph showing a relationship between an ambience humidity and an ambient coefficience H at the primary transfer portion in Embodiment 1.

FIG. 7 is a graph showing the relationship between the environmental humidity (abscissa) and the environmental coefficient H (ordinate). Referring to FIG. 7, it has been found that the environmental coefficient H is decreased when the environmental humidity is smaller than 10 g/kg. In this case, the slope of the line ② shown in FIG. 6 becomes smaller.

As described above, according to this embodiment, even if the environmental humidity fluctuates, it is possible to prevent a loss of time due to the ATVC by determining an optimum transfer bias at another speed through calculation on the basis of a result at the time of performing the ATVC only at a certain transfer speed.

Further, in the case of setting three or more transfer speeds, it becomes possible to minimize a time required for performing the ATVC by effecting the ATVC at the fastest transfer speed.

Incidentally, input of the environmental coefficient H into the control means may be performed in a manner that the environmental coefficient H obtained from the absolute humidity as shown in FIG. 7 is inputted into the control means by using an input means (not shown) after users measure an absolute humidity in an actual ambient environment or that a detection means such as a sensor is provided to the image forming apparatus and an absolute humidity detected by the detection means is automatically inputted into the control means.

Further, the ATVC may be performed at a predetermined timing, such as in the middle of pre-multiple rotation for warming up the fixing apparatus, during the pre-rotation in image forming operation, for each predetermined time of printing sheets, or for each predetermined elapsed time. Further, specifics of the ATVC are also not limited to those described in this embodiment.

Embodiment 2

In this embodiment, an optimum transfer voltage at different toner speeds is obtained through calculation similarly as in Embodiment 1 in the ATVC operation at the secondary transfer portion of the above-mentioned image forming apparatus and means and members identical to those in Embodiment 1 are indicated by identical reference numerals and explanations therefor are omitted.

Figure 8:
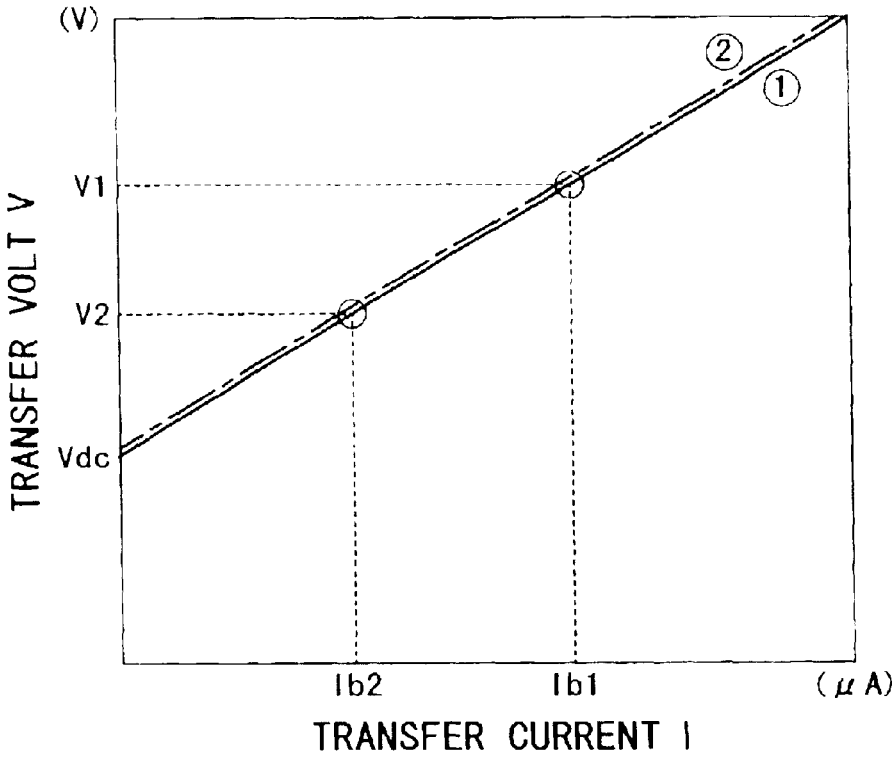
FIG. 8 is a graph showing a relationship between a transfer current and transfer voltage at a secondary transfer portion in Embodiment 2.

FIG. 8 is a graph, obtained through our experimental results, showing a relationship between the transfer voltage V and the transfer current I applied at the secondary transfer portion of the image forming apparatus according to Embodiment 1, i.e., applied between the secondary transfer rollers 56 and 57, when different toner speeds are set.

As shown in FIG. 8, a line ① represents a relationship between the transfer voltage V and the transfer current I at a transfer speed S1.

If a transfer voltage when an optimum transfer current Ib1 flows is V1, the transfer voltage V1 is represented by the following equation:

$$V1=k\times Ib1+Vdc \quad (8)$$

(k: coefficient, Vdc: discharge start voltage)

In this case, a relationship between the transfer voltage V and the transfer current I at a transfer speed S2 (S1>S2) is indicated by a line ② (broken line).

If a transfer voltage when an optimum transfer current Ib2 flows is V2, the transfer voltage V2 is represented by the following equation:

$$V2=A\times k\times Ib2+Vdc \quad (9)$$

(A, k: coefficient, Vdc: discharge start voltage)

The coefficient k is common to the equations (8) and (9), and the discharge start voltages Vdc of the equations (8) and (9) show an identical value from the experimental results although they vary depending on the environmental humidity but are irrespective of the transfer speed. Further, similarly as in Embodiment 1, the coefficient A is a coefficient representing a change (difference) in slope of the transfer voltage V and the transfer current I at different transfer speeds. However, at the secondary transfer portion in this embodiment, the coefficient A is represented by the following equation:

$$A=1 \quad (10).$$

More specifically, in this embodiment, the relationship between the transfer voltage and the transfer current at the secondary transfer portion is substantially constant irrespective of the transfer speed.

The relationship between the transfer voltage and the transfer current exhibits resistive behavior such that a time factor does not affect the voltage-current characteristic. Accordingly, at the secondary transfer portion, the inner secondary transfer roller 56 has a low resistance and the outer secondary transfer roller 57 has a medium resistance, so that the resistive behavior at the secondary transfer portion is considered to be different from the behavior at the primary transfer portion where the photosensitive drum 1 having the insulating (dielectric) layer is present. The transfer roller is liable to exhibit such a resistive behavior in a range of volume resistivity of not more than about $10^{11}$ ohm.cm.

As a result, the relationships between the transfer voltages and the transfer currents are represented by the following equations:

$$V1=k\times Ib1+Vdc \quad (11)$$

(k: coefficient, Vdc: discharge start voltage), and $$V2=k\times Ib2+Vdc \quad (12)$$

(k: coefficient, Vdc: discharge start voltage).

On the other hand, as described in Embodiment 1, the optimum transfer current is proportional to the transfer speed, the following equation holds:

$$Ib2=(S2/S1)\times Ib1 \quad (4).$$

From these equations (11), (12) and (4), the transfer voltage V2 is represented by the following equation:

$$V2=(S2/S1)\times(V1-Vdc)+Vdc \quad (13).$$

This equation (13) is identical to the above-mentioned equation (6) where the coefficient A is 1. This means in FIG. 8 that the optimum transfer voltage and the transfer speed are proportional to each other except for the discharge start voltage Vdc.

As described above, according to this embodiment, even in the image forming apparatus different in behavior from Embodiment 1 in that the relationship between the transfer voltage an the transfer current does not vary depending on the transfer speed, it is possible to prevent a loss of time due to the ATVC by determining an optimum transfer bias at another speed through calculation on the basis of a result at the time of performing the ATVC only at a certain transfer speed.

Embodiment 3

In this embodiment, an optimum transfer voltage at different transfer speeds is obtained through calculation similarly as in Embodiment 2 even when a resistance characteristic of the transfer member is changed with time in the ATVC operation at the secondary transfer portion of the above-mentioned image forming apparatus.

Figure 9:
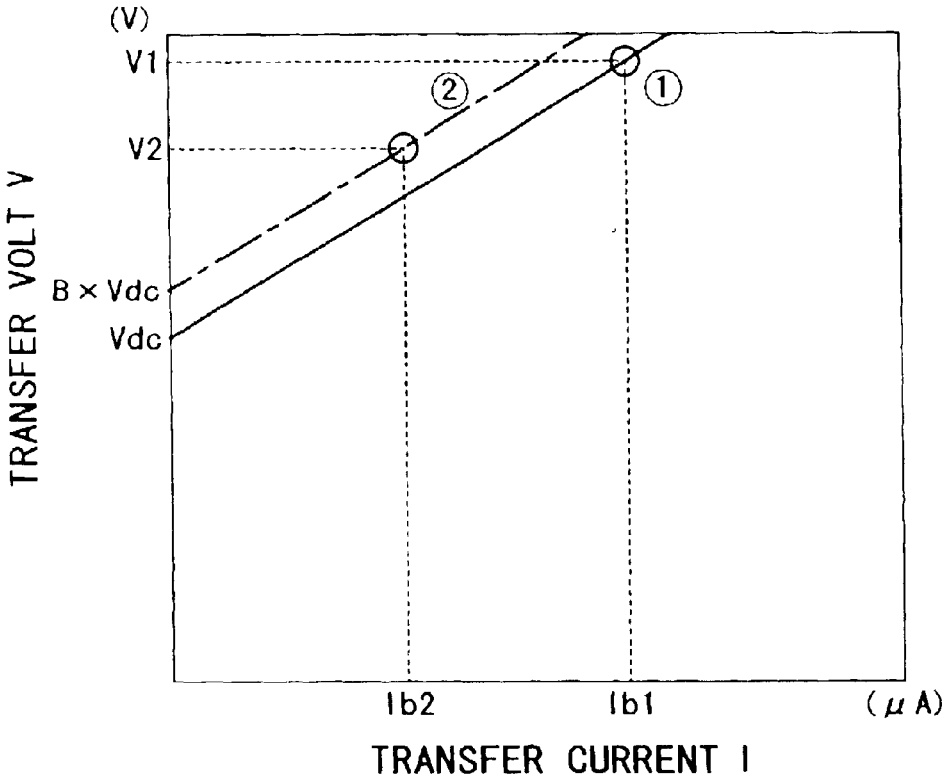
FIG. 9 is a graph showing a relationship between a transfer current and a transfer voltage at the secondary transfer portion in Embodiment 2 when a transfer member is deteriorated in successive image formation.
Figure 10:
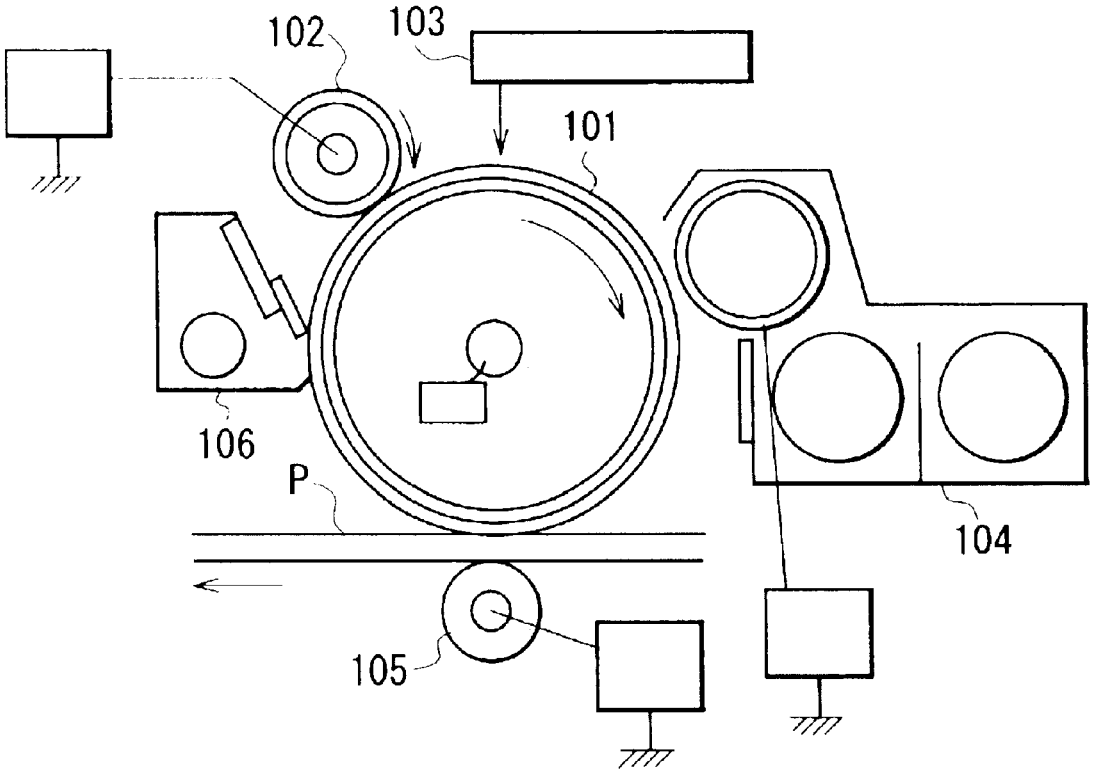
FIG. 10 is a view showing a conventional image forming apparatus.

FIG. 9 is a graph, obtained through our experimental results similarly as in Embodiment 2, showing a relationship between the transfer voltage V and the transfer current I at different transfer speeds in the case where a resistance of the outer secondary transfer roller 57 at the secondary transfer portion of the image forming apparatus according to Embodiment 1 is increased in successive image formation.

As shown in FIG. 9, a line 1 represents a relationship between the transfer voltage V and the transfer current I at a transfer speed S1.

If a transfer voltage when an optimum transfer current Ib1 flows is V1, the transfer voltage V1 is represented by the following equation:

$$V1=k\times Ib1+Vdc \quad (14)$$

(k: coefficient, Vdc: discharge start voltage).

In this case, a relationship between the transfer voltage V and the transfer current I at a transfer speed S2 (S1>S2) is indicated by a line 2 (broken line).

If a transfer voltage when an optimum transfer current Ib2 flows is V2, the transfer voltage V2 is represented by the following equation:

$$V2=k\times Ib2+B\times Vdc \quad (15)$$

(k, B: coefficient, Vdc: discharge start voltage).

According to the experimental results, at different transfer speeds, the slopes of the transfer voltages and the transfer currents (the lines 1 and 2) are identical to each other but the discharge start voltages are different from each other. For this reason, in the equation (15), the discharge start voltage at the transfer speed S2 is indicated as B×Vdc.

On the other hand, as described in Embodiment 1, the optimum transfer current is proportional to the transfer speed, so that the optimum transfer current Ib2 is represented by the following equation:

$$Ib2=(S2/S1)\times Ib1 \quad (4).$$

From these equations (14), (15) and (4), the transfer voltage V2 is represented by the following equation:

$$V2=(S2/S1)\times(V1-Vdc)+B\times Vc\ (B>0) \quad (16)$$

wherein B is a coefficient as to an increase in resistance in successive image formation.

If the coefficient B is defined as a durability coefficient L in terms of a count, the equation (16) is modified into the following equation:

$$V2=(S2/S1)\times(V1-Vdc)+L\times Vdc\ (L>0) \quad (17)$$

As described above, according to this embodiment, even in the image forming apparatus different in behavior from Embodiments 1 and 2 in that the relationship between the transfer voltage an the transfer current varies depending on the transfer speed due to a change in resistance characteristic of the member constituting the secondary transfer portion in successive image formation, it is possible to prevent a loss of time due to the ATVC by determining an optimum transfer bias at another speed through calculation on the basis of a result at the time of performing the ATVC only at a certain transfer speed.

The durability coefficient L as a counted value is set to a larger value as a time for image formation is longer (the number of sheets on image formation is larger).

Incidentally, from the equations (6) and (8) derived in the above-mentioned embodiments:

$$V2=A\times(S2/S1)\times(V1-Vdc)+Vdc \quad (6),$$

$1\leqq A\leqq S1/S2$ (where S1>S2), and $$V2=(S2/S1)\times(V1-Vdc)+B\times Vdc \quad (16)$$

(B>0), an optimum transfer voltage V2 at different transfer speeds is represented by the following equation:

$$V2=A\times(S2/S1)\times(V1-Vdc)+B\times Vdc \quad (18),$$

with the proviso that S1>S2, $1\leqq A\leqq S1/S2$, and B>0.

The coefficient A is determined based on conditions including the environmental humidity, and the coefficient B is determined based on conditions including a deterioration of the members constituting the transfer portions in successive image formation. The coefficient B is a coefficient for representing a change in discharge start voltage in successive image formation, so that the coefficient B may preferably satisfy the relationship: $B \geqq 1$.

Other Embodiments

In the above-described embodiments, the image forming apparatus using the intermediary transfer member is employed. However, in a similar manner, it is possible to determine an optimum transfer voltage at different transfer speeds through calculation even in an image forming apparatus of a direct transfer scheme wherein image transfer is directly performed from the image bearing member onto the transfer medium.

Further, in the above embodiments, the printer is exemplified as the image forming apparatus of the present invention. However, it is possible to use, e.g., a facsimile apparatus or a copying machine as the image forming apparatus.

What is claimed is:

1. An image forming apparatus comprising:

image forming means for forming an image on a first image bearing member, a transfer member, capable of contacting the first image bearing member, for transferring the image on the first image bearing member to a second image bearing member, a power supply for applying a bias to the transfer member, detection means for detecting a voltage value and a current value at the time of applying the bias to said transfer member, speed change means capable of changing a moving speed of the first image bearing member, environment detection means for detecting a temperature or a humidity, and control means for determining a transfer voltage value at the time of image transfer on the basis of an output of said detection means at the time of applying the bias to said transfer member other than the time of image transfer, wherein said image forming means is capable of forming an image different speeds, and said control means determines a transfer voltage value, on the basis of an output of said detection means at a predetermined speed of the first image bearing member and an output of said environment detection means, at a speed other than the predetermined speed.

2. An apparatus according to claim 1, wherein said control means determines the transfer voltage value at the predetermined speed on the basis of current values at the time of applying at least two different voltage values at the predetermined speed.

3. An apparatus according to claim 2, wherein said control means determines the transfer voltage value at the speed other than the predetermined speed on the basis of the transfer voltage value at the predetermined speed and the output of said environmental detection means.

4. An apparatus according to claim 1, wherein when the predetermined speed is S1, the speed other than the predetermined speed is S2, a voltage value providing an objective transfer current at the predetermined speed is V1, a discharge start voltage at the time of applying the bias to said transfer member is Vdc, and a coefficient determined on the basis of the output of said environment detection means is H, a transfer voltage value V2 at the speed S2 is determined by the following equation:

$$V2 = H \times (S2/S1) \times (V1 - Vdc) + Vdc,$$

with the proviso that $1 \leqq H \leqq S1/S2$ and $S1 > S2$.

5. An apparatus according to claim 1, wherein the apparatus further comprises counting means for counting a time of image formation, and when the predetermined speed is S1, the speed other than the predetermined speed is S2, a voltage value providing an objective transfer current at the predetermined speed is V1, a discharge start voltage at the time of applying the bias to said transfer member is Vdc, a coefficient determined on the basis of the output of said environment detection means is H, and a count determined on the basis of a result counted by said counting means is L; a transfer voltage value V2 at the speed S2 is determined by the following equation:

$$V2 = H \times (S2/S1) \times (V1 - Vdc) + L \times Vdc,$$

with the proviso that $1 \leqq H \leqq S1/S2$, $S1 > S2$ and $L > 0$.

6. An apparatus according to claim 4 or 5, wherein the coefficient H provides a value, when a humidity detected by said environment detection means is smaller than a predetermined value, smaller than a value thereof when the humidity is larger than the predetermined value.

7. An apparatus according to claim 5, wherein the count L provides a larger value as a count counted by said counting means becomes larger.

8. An apparatus according to claim 1, wherein the first image bearing member has a dielectric layer exhibiting a volume resistivity of not less than $10^{14}$ ohm.cm.

9. An apparatus according to claim 1, wherein the first image bearing member has a photoconductive layer capable of forming an electrostatic latent image, and the second image bearing member is an intermediary transfer member for carrying and transferring an image once receiving from the first image bearing member onto a transfer medium.

10. An apparatus according to claim 1, wherein the first image bearing member is an intermediary transfer member for carrying an transferring an once received image onto a transfer medium, and the second image bearing member is the transfer medium.

11. An apparatus according to claim 1, wherein the predetermined speed is fastest of the different speeds.

* * * * *

UNITED STATES PATENT AND TRADEMARK OFFICE

CERTIFICATE OF CORRECTION

PATENT NO. : 6,804,481 B2
DATED : October 12, 2004
INVENTOR(S) : Jun Mochizuki et al.

It is certified that error appears in the above-identified patent and that said Letters Patent is hereby corrected as shown below:

Title page, Item [54] and Column 1, line 1,
Title, "IMAGE FORMING APPARATUS" should read -- TRANSFER CONTROL FOR AN IMAGE FORMING APPARATUS --.

Drawings,
Sheet 7 of 7, add the legend -- Prior Art --.

Column 1,
Line 13, "ATVC (active transfer voltage control)" should read -- an ATVC (active transfer voltage control) --.
Line 25, "an" should read -- and --.
Line 50, "this," should read -- this --.
Line 64, "an" should read -- a --.

Column 2,
Lines 8 and 9, "rotation" should read -- rotational --.
Line 10, "of" should read -- of the --.
Line 15, "sheet" should read -- sheets --.
Line 16, "a speed of" should read -- the speed of the --.
Line 27, "for" should read -- for the --.
Line 30, "has" should read -- is --.

Column 3,
Line 47, "coefficience" should read -- coefficient --.

Column 4,
Lines 6 and 7, "apparatus" should read -- apparatuses --.
Line 18, "in" should be deleted; and "drum" should read -- drums --
Line 28, "an" should read -- a --.
Line 49, "in" should be deleted.

Column 5,
Line 33, "member of, e.g.," should read -- member, e.g., a --.
Line 51, "toner etc." should read -- toner, etc., --.
Line 52, "toner" should read -- toner, --.
Line 53, "etc." should read -- etc., --.

UNITED STATES PATENT AND TRADEMARK OFFICE

CERTIFICATE OF CORRECTION

PATENT NO. : 6,804,481 B2
DATED : October 12, 2004
INVENTOR(S) : Jun Mochizuki et al.

It is certified that error appears in the above-identified patent and that said Letters Patent is hereby corrected as shown below:

Column 6,
Line 1, “a” should read -- an --.
Line 18, “portion 82,” should read -- portion, --.
Line 57, “control the” should read -- controls the --.

Column 7,
Line 21, “method” should read -- method is used --.
Line 27, “rotating” should read -- rotation --.
Line 35, “transfer, is used,” should read -- transfer. --.
Line 57, “rotation” should read -- rotation is performed --.
Line 61, “portion is performed” should read -- portion, --.

Column 8,
Line 30, “tart” should read -- start --.

Column 11,
Line 42, “an” should read -- and --.
Line 51, “larly as in” should read -- lar to --.
Line 56, “similarly as in” should read -- similar to --.

Column 12,
Line 29, “Vc(B>0)” should read -- Vdc(B>0) --.
Line 41, “an” should read -- and --.

Column 13,
Line 47, Close up the right margin.
Lines 48-49, Indent.

UNITED STATES PATENT AND TRADEMARK OFFICE

CERTIFICATE OF CORRECTION

PATENT NO. : 6,804,481 B2
DATED : October 12, 2004
INVENTOR(S) : Jun Mochizuki et al.

It is certified that error appears in the above-identified patent and that said Letters Patent is hereby corrected as shown below:

Column 14,
Line 46, "once receiving" should read -- received --.

Signed and Sealed this

Twenty-second Day of February, 2005

JON W. DUDAS
*Director of the United States Patent and Trademark Office*